US010515571B2

(12) United States Patent
Boudeman

(10) Patent No.: US 10,515,571 B2
(45) Date of Patent: Dec. 24, 2019

(54) LAYERED SIGNAGE SYSTEM

(71) Applicant: SSPP PERU SAC, Miraflores (PE)

(72) Inventor: Joseph W. Boudeman, Pacifica, CA (US)

(73) Assignee: SSPP PERU SAC, Miraflores (PE)

( * ) Notice: Subject to any disclaimer, the term of this patent is extended or adjusted under 35 U.S.C. 154(b) by 0 days.

(21) Appl. No.: 15/120,735

(22) PCT Filed: Nov. 13, 2014

(86) PCT No.: PCT/US2014/065559

§ 371 (c)(1),
(2) Date: Aug. 22, 2016

(87) PCT Pub. No.: WO2015/126481

PCT Pub. Date: Aug. 27, 2015

(65) Prior Publication Data

US 2016/0365013 A1 Dec. 15, 2016

Related U.S. Application Data

(60) Provisional application No. 61/943,199, filed on Feb. 21, 2014.

(51) Int. Cl.

| | |
|---|---|
| ***G09F 15/00*** | (2006.01) |
| ***G09F 15/02*** | (2006.01) |
| ***G09F 17/00*** | (2006.01) |

(52) U.S. Cl.

CPC ..... *G09F 15/0006* (2013.01); *G09F 15/02* (2013.01); *G09F 17/00* (2013.01)

(58) Field of Classification Search

CPC ... G09F 15/00; G09F 15/0012; G09F 15/0018
See application file for complete search history.

(56) References Cited

U.S. PATENT DOCUMENTS 2,052,771 A * 9/1936 Johnson ..... G09F 7/002 40/606.18
2,065,097 A * 12/1936 Rogers ..... G09F 7/18 40/606.18
3,102,351 A * 9/1963 Howell ..... G09F 15/0012 40/606.18
3,138,886 A * 6/1964 Cobb ..... G09F 15/0018 40/604
3,406,475 A * 10/1968 O'Donnell ..... G02B 6/0021 362/23.15
4,263,739 A * 4/1981 Lee ..... G09F 7/18 40/606.18

(Continued)

FOREIGN PATENT DOCUMENTS

DE 20315284 U1 12/2003
GB 9003056.0 A 8/1991

*Primary Examiner* — Cassandra Davis
(74) *Attorney, Agent, or Firm* — West & Associates, A PC; Stuart J. West

(57) ABSTRACT

A signage system comprising a first panel and a second panel arranged in a substantially parallel configuration, wherein portions of the first panel and second panel are kept apart at a predetermined distance by a plurality of spacers, thereby providing a space between the first panel and second panel that can enhance the visibility of designs on the first panel and second panel.

19 Claims, 9 Drawing Sheets

(56) References Cited

U.S. PATENT DOCUMENTS

| | | | | |
|---|---|---|---|---|
| 4,793,082 | A * | 12/1988 | Petrick | G09F 15/02 40/606.18 |
| 4,805,324 | A * | 2/1989 | Andersson | G09F 13/04 40/541 |
| 5,230,172 | A * | 7/1993 | Hsu | A47G 1/06 248/497 |
| 5,551,178 | A * | 9/1996 | Foley | G09F 15/0062 248/431 |
| 5,941,002 | A * | 8/1999 | Rusin | G09F 19/22 40/605 |
| 6,263,602 | B1 | 7/2001 | Seiber et al. | |
| 6,279,822 | B1 * | 8/2001 | Bertram | A47F 3/004 220/315 |
| 6,485,862 | B1 * | 11/2002 | Yoshioka | H01M 6/5072 29/623.2 |
| 6,719,276 | B1 * | 4/2004 | Bush | E04H 17/16 256/1 |
| 7,150,119 | B1 * | 12/2006 | Nudo, Jr. | G09F 7/00 40/615 |
| 7,549,245 | B2 * | 6/2009 | Ter-Hovhannissian | G09F 7/22 40/546 |
| 9,390,637 | B2 * | 7/2016 | Varveris | G09F 13/0413 |
| 2007/0204499 | A1 * | 9/2007 | Sudack | G09F 15/0012 40/734 |
| 2012/0085005 | A1 * | 4/2012 | Mackler | G09F 11/025 40/492 |
| 2014/0007474 | A1 | 1/2014 | Varveris | |

* cited by examiner

LAYERED SIGNAGE SYSTEM

CLAIM OF PRIORITY

This Application claims priority under 35 U.S.C. § 119(e) from earlier filed U.S. Provisional Application Ser. No. 61/943,199, filed Feb. 21, 2014, by Joseph W. Boudeman, the entirety of which is incorporated herein by reference.

FIELD OF THE INVENTION

The present disclosure relates to the field of making signs, specifically a system and method for making layered signage.

BACKGROUND

Signage such as signs, banners, and flags are often displayed to disseminate information, advertise, and/or to decorate spaces. Many types of signage have designs, such as text and/or images, displayed on solid materials such as vinyl or fabric. However, signage made of solid materials is often not very durable when are subjected to wind gusts, rain, and other elements over time. Exposure to such elements can stretch or tear solid materials, and/or can cause damage to mounting rods.

Signage made of porous materials, such as mesh, often fares better against the elements than signage made of solid, nonporous materials. For instance, wind and rain can at least partially pass through the pores of mesh banners, leading to less wear and tear when compared to nonporous banners. As signage made of porous materials experience lower levels of damaging forces than signage made of solid, nonpourous materials, it can often last longer and/or be more durable. Signage made of porous material also has other advantages over signage made of nonporous material, such as often being lighter and/or more flexible.

However, although constructing signage out of porous material is often desirable, doing so can have unique challenges. One such challenge is with dual-sided signage, in which designs are displayed on both sides of a two-sided sign, flag, banner, or other type of signage. When designs are printed on both sides of a single piece of porous material, ink from one side generally bleeds through the pores of the material and becomes viewable from the opposing side. This tends to obscure the designs on both sides. While in some cases mirror images can be printed on opposing sides, such that ink from one side bleeds through pores into corresponding positions on the reversed mirror image design on the opposite side, many designs cannot be reversed as a mirror image. For example, reversed text would be unreadable, and many logos or other images are not designed to be reversed.

To combat these problems, some dual-sided signage systems have been constructed using layers that each display their own designs. In one method, two separate layers are each printed with a design on one side, and then the non-printed sides of the separate layers are joined together. In another method, designs are printed at different locations along one side of a long piece of material, and then the long material is folded over on itself to create two layers.

However, existing techniques of making dual-sided signage with layers using either porous or non-porous materials have problems with image quality, as designs on a back layer are often still visible through a front layer because the layers are generally placed directly against each other back-to-back. By way of a non-limiting example, FIGS. 1A-1C depict an exemplary embodiment of prior art dual-sided signage 100. As shown in FIGS. 1A-1C, in many existing construction methods, a first panel 102 and a second panel 104 are coupled back-to-back directly with each other, with each of the first panel 102 and second panel 104 being made of porous material such as mesh. A first design 106 is affixed to or printed on a face of the first panel 102, and a second design 108 is affixed to or printed on a face of the second panel 104, as shown in FIG. 1A. The first panel 102 and the second panel 104 are coupled directly back to back, as shown in FIG. 1B. As can be seen from FIG. 1C, when the signage is constructed with traditional layering techniques the second design 108 can be seen in a reversed orientation through the pores of the first panel 102 and second panel 104, such that the second design 108 obscures and conflicts with the first design 106.

Similar problems exist with layered dual sided-signage systems constructed with two layers of nonporous materials, as a design on one layer can still show through a second layer. By way of a non-limiting example, when the sun shines on the back side of a dual-sided sign made of multiple layers of nonporous material, shadows of text or designs on the back layer can impact visibility and/or readability of text or designs on the front layer. By way of another non-limiting example, when the nonporous layers are made of a thin material, the designs on one layer are often still visible through the other layer when the layers are coupled directly back-to-back.

What is needed is a signage system comprising a first panel and second panel, in which the first panel and second panel are at least partially kept apart at a predetermined distance by a plurality of spacers, such that the space between the first panel and second panel can enhance visibility of designs on the first panel and second panel.

DETAILED DESCRIPTION

Figure 2A:
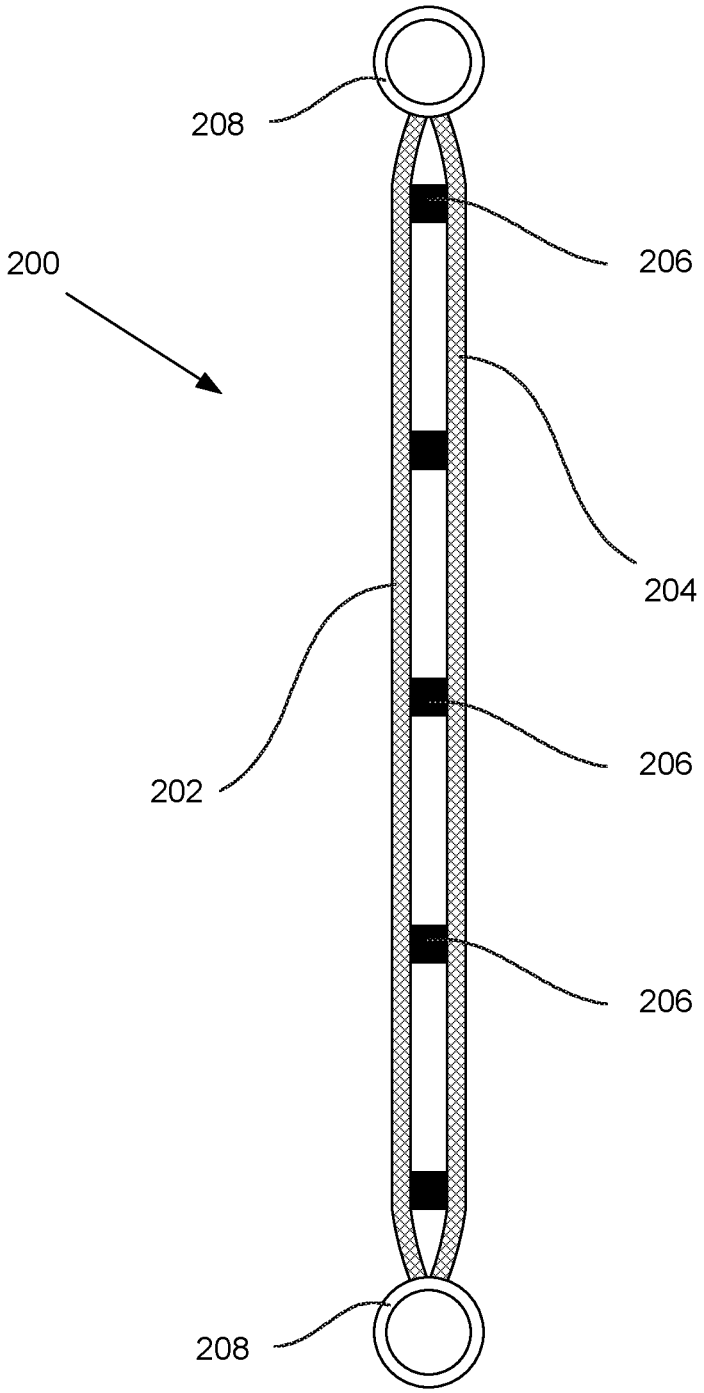
FIG. 2A depicts a cross-section of an embodiment of a signage system comprising spacers.
Figure 2B:
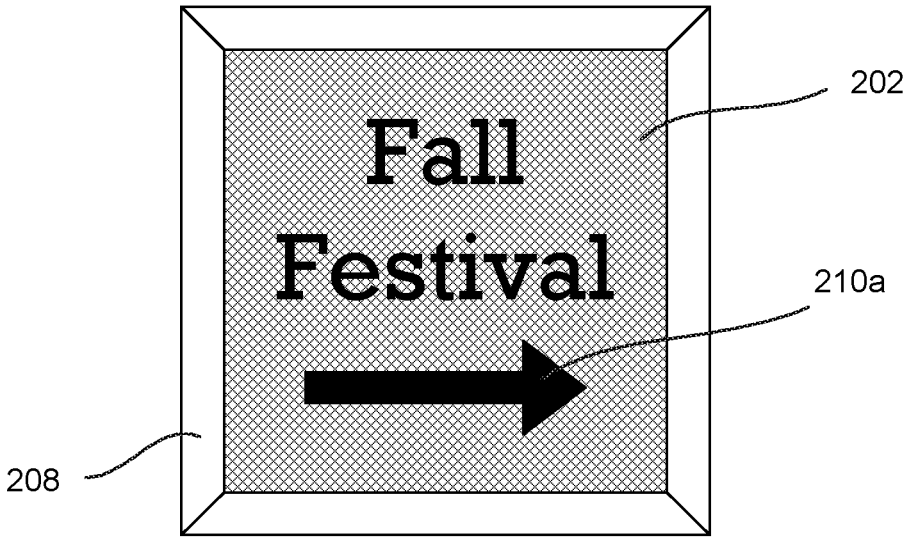
FIGS. 2B-2C depict a front and back side of an embodiment of a signage system.
Figure 2C:
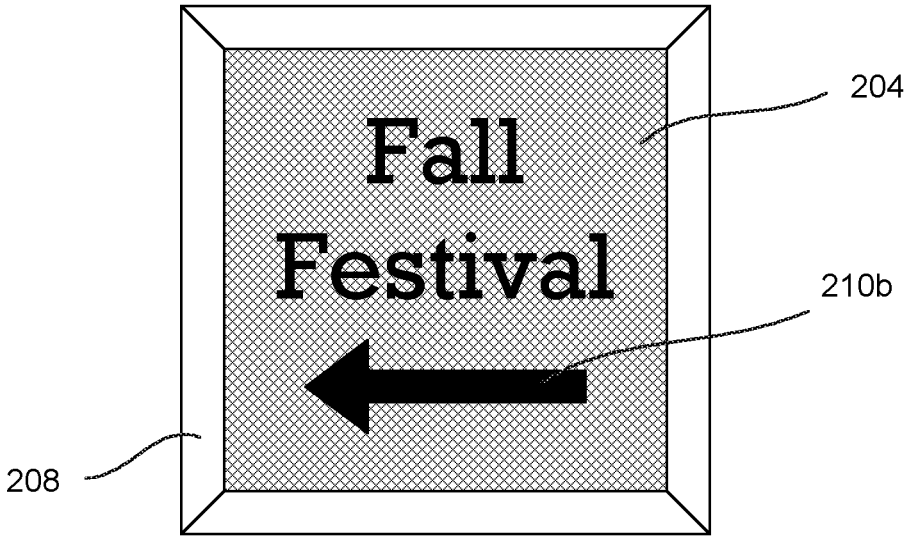

FIGS. 2A-2C depicts an exemplary embodiment of a signage system 200. FIG. 2A depicts a cross-sectional view of a signage system 200, while FIGS. 2B and 2C depict views of the front and back sides of a signage system 200. A signage system 200 can comprise a first panel 202, a second panel 204, one or more spacers 206, and/or one or more mounting members 208. The first panel 202 and/or second panel 204 can display one or more designs 210.

The first panel 202 and second panel 204 can each be a substantially planar member. In some embodiments, one or both of the first panel 202 and second panel 204 can at least partially be made of a porous material such as mesh, or an otherwise solid material such as vinyl, plastic, fabric, or any other material that has been perforated with a plurality of pores or holes. By way of a non-limiting example, the first panel 202 and/or second panel 204 can be made of a lightweight mesh material that allows at least some wind and/or moisture to pass through the pores of the mesh material, thereby minimizing wind interference and/or undesirable movement of the signage system 200 when in use. In alternate embodiments, one or both of the first panel 202 and second panel 204 can at least partially be made of solid and nonporous material such as vinyl, polymer, fabric, plastic, silicone, metal, or any other desired material or combination of materials.

In some embodiments, the first panel 202 and second panel 204 can be made of the same materials, while in other embodiments the first panel 202 and second panel 204 can be made of different materials. In still other embodiments, the first panel 202 and second panel 204 can be sections of the same piece of material that is folded in on itself, as discussed below with reference to FIG. 4. In some embodiments, the first panel 202 and/or second panel 204 can have anti-mold, anti-fungal, and/or anti-bacterial coating and/or inherent properties.

One or both of the first panel 202 and second panel 204 can display one or more designs 210. By way of a non-limiting example, FIG. 2B depicts the first panel 202 displaying a design 210*a*, and FIG. 2C depicts the second panel 204 displaying a design 210*b*. A design 210 can comprise text, logos, photographs, artwork, patterns and/or other any other type of image or design. In some embodiments a design 210 can be printed, painted, drawn, or be otherwise applied directly on a surface of the first panel 202 or second panel 204. In other embodiments, a design 210 can be formed separately and applied to the surface of the first panel 202 or second panel 204. By way of a non-limiting example, a design 210 can be created on a decal, applique, or sticker that is then applied to the surface of the first panel 202 or second panel 204. In some embodiments the first panel 202 and second panel 204 can display instances of the same design 210, while in other embodiments the first panel 202 and second panel 204 can display different designs 210. In still other embodiments, one or both of the first panel 202 and second panel 204 can be left blank without a design 210. In yet other embodiments, the first panel 202 and/or second panel 204 can have one design 210 displayed on one side and a second design 210 displayed on the other side of the same panel.

As shown in FIG. 2A, the first panel 202 and second panel 204 can be spaced at least partially apart by one or more spacers 206. One or more spacers 206 can be positioned between the first panel 202 and second panel 204, such that the spacers 206 keep portions of the first panel 202 and second panel 204 apart by a predetermined distance. The spacers 206 can be coupled with the first panel 202 and/or second panel 204 via adhesives, snaps, hook and loop fasteners, threading, heat bonding, physical engagement with the pores of porous material, and/or any other known and/or convenient manner of coupling. As will be discussed below, in alternate embodiments the spacers 206 can be replaced by, or be used in addition to, a frame 700 and/or intermediate panels 600.

Figure 3A:
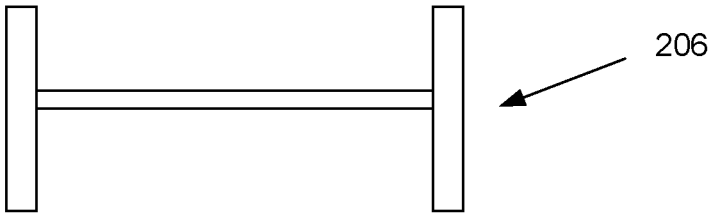
FIGS. 3A-3C depict various embodiments of spacers.
Figure 3B:
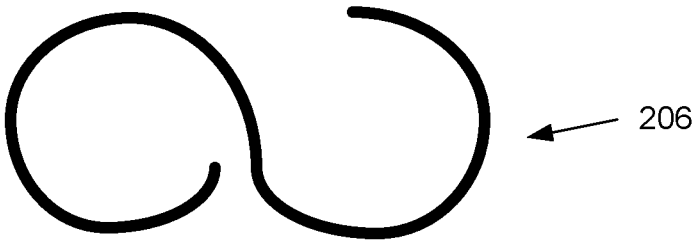
Figure 3C:
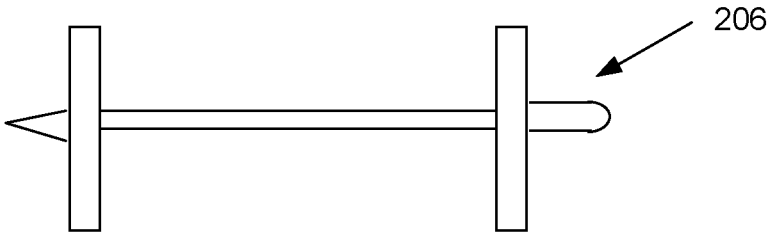

In some embodiments, a spacer 206 can have a horizontal elongated member positioned between a vertical member at each end, as shown in FIG. 3A. In other embodiments, a spacer 206 can be an S-shaped hook, as shown in FIG. 3B. In still other embodiments, a spacer 206 can have one or more protrusions configured to pass through pores of the first panel 202 and/or second panel 204, when the first panel 202 and/or second panel 204 comprise porous material. In yet other embodiments, a spacer 206 can have any other known and/or convenient configuration.

In some embodiments, the spacers 206 can be made of metal. In other embodiments, the spacers 206 can be made of plastic, silicone, wood, or any other desired material or combination of materials.

In some embodiments, the first panel 202 and second panel 204 can be coupled with one or more mounting members 208 that are configured to hold the first panel 202 and second panel 204 in a substantially parallel configuration, as shown in FIG. 2A. In other embodiments, the mounting members 208 can hold the first panel 202 and second panel 204 in any other desired configuration relative to each other. By way of a non-limiting example, in alternate embodiments mounting members 208 can be angled or positioned such that the first panel 202 and second panel 204 are in a V-shaped configuration. In still other embodiments, more than two panels can be present, and the mounting members 208 and/or spacers 206 can position the panels in a triangular cross section, a square cross section, a pentagonal cross section, or any other desired configuration. In alternate embodiments, the panels can be mounted on a frame 700 instead of mounting members 208, as will be discussed below.

Mounting members 208 can be poles, bars, planks, hooks, grooves, and/or any other device configured to couple with the first panel 202 and/or second panel 204. The mounting members 208 can be made of plastic, metal, wood, polymer, and/or any other known and/or convenient material or combination of materials.

In some embodiments, one or more mounting members 208 can be coupled with the first panel 202 and/or second panel 204 with adhesives, screws, bolts, snaps, hook and loop fasteners, or any other known and/or convenient manner of coupling. In other embodiments, the first panel 202 and/or second panel 204 can be draped over and/or around one or more mounting members 208.

In some embodiments, two mounting members can be coupled with the first panel 202 and second panel 204 on opposing ends of the signage system 200. By way of a non-limiting example, FIG. 2A depicts an exemplary embodiment in which one mounting member 208 can be coupled with the first panel 202 and/or second panel 204 proximate to the top of the signage system 200 and another mounting members 208 can be coupled with the first panel 202 and/or second panel 204 proximate to the bottom of the signage system 200.

In other embodiments, the signage system can comprise a single mounting member 208. By way of a non-limiting example, FIG. 4 depicts a cross section of an embodiment of a signage system 200 in which the first panel 202 and second panel 204 are formed from a single piece of material that is draped and/or secured over a mounting member 208 proximate to the top of the signage system 200.

Figure 4:
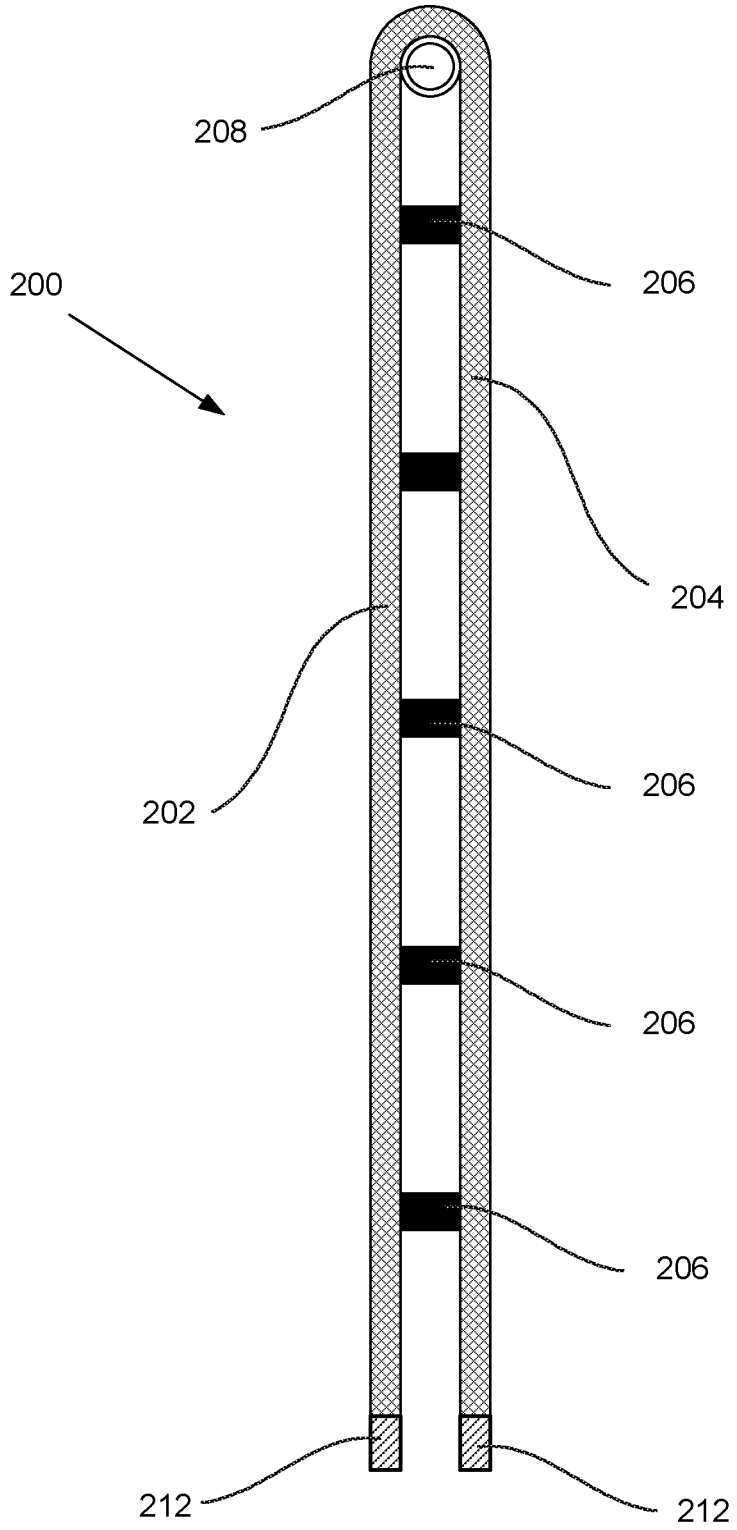
FIG. 4 depicts an embodiment of a signage system comprising weighted members.

In some embodiments, one or more lower portions of the first panel 202 and/or second panel 204 can have weighted members 212 to weigh down and stabilize the first panel 202 and/or second panel 204, as shown in FIG. 4. The weighted members 212 can in some situations and/or embodiments assist in at least partially inhibiting excessive and/or undesired movement of the signage system 200 from wind, vibration, or other forces.

In still other embodiments, a signage system 200 can have any other desired number of mounting members 208 coupled with the first panel 202 and/or second panel 204 in any desired configuration. In alternate embodiments, the first panel 202 and second panel 204 can be affixed directly to one another at one or more positions, and the mounting members 208 can be absent.

Figure 5A:
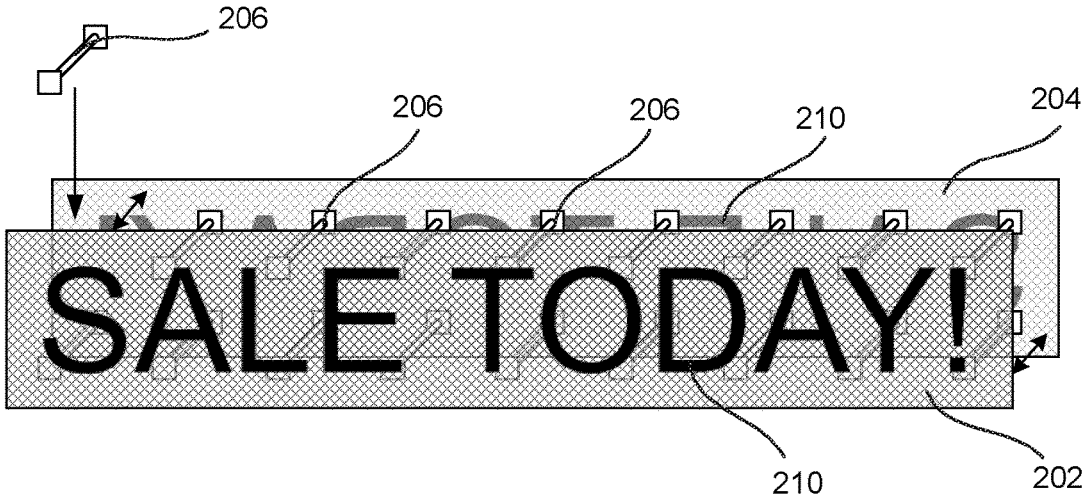
FIGS. 5A-5B depict a method of constructing a signage system.
Figure 5B:
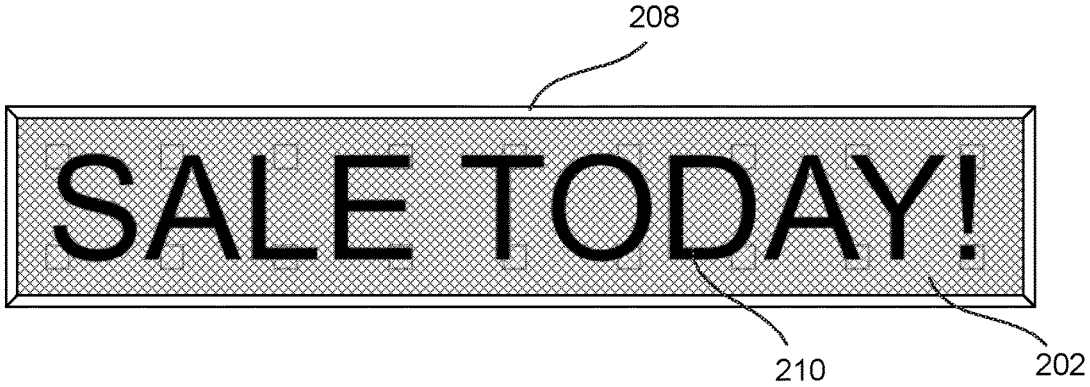

FIGS. 5A-5B depicts a method of assembling a signage system 200. As shown in FIG. 5A, a first panel 202 and a second panel 204 can be arranged back to back with their designs 210 facing outward, and one or more spacers 206 can be coupled between the interior surfaces of the first panel 202 and second panel 204. As shown in FIG. 5B, at least one edge of the first panel 202 and at least one edge of the second panel 204 can be coupled with one or more mounting members 208. Alternately, when the first panel 202 and second panel 204 are sections of a larger piece of material, the first panel 202 and second panel 204 can be draped or secured over a mounting member 208, as shown in FIG. 4.

As can be seen from FIG. 5B, the space between the first panel 202 and second panel 204 due to presence of the spacers 206 decreases the visibility of designs 210 that are on the opposite side of the signage system 200. Because the first panel 202 and second panel 204 are spaced at least partially apart, a design 210 on one panel is not as visible through the other panel as it would be if the inner surfaces of the panels were directly touching back-to-back. By way of a non-limiting example, the design 210 on the second panel 204 obscures the design 210 on the first panel 202 in FIG. 5B to a lesser degree than the second design 108 obscures the first design 106 in FIG. 1C, because the first panel 202 and second panel 204 are spaced apart in FIG. 5B by spacers 206. Due to the distance between the first panel 202 and second panel 204 provided by the spacers 206, a viewer facing the first panel 202 can be less likely to see through the pores of the first panel 202 and see the back side of the second panel 204 (and the design 210 on the second panel 204 that might be partially visible in reversed orientation through the back side of the second panel 204), thereby making the design 210 on the first panel 202 more pronounced than with existing systems that have no space between the first panel 202 and second panel 204. In some situations, the presence of the second panel 204 can also partially block light from illuminating the back side of the first panel 202, also making the design 210 on the first panel 202 more pronounced to a viewer.

FIG. 6 depicts an alternate embodiment in which a signage system 200 further comprises one or more intermediate panels 600 positioned between the first panel 202 and second panel 204. The intermediate panels 600 can be coupled with, and/or be held in place by, the mounting members 208, first panel 202, second panel 204, and/or spacers 206.

The intermediate panels 600 can be substantially planar members. In some embodiments intermediate panels 600 can at least partially be made of a porous material, while in other embodiments intermediate panels 600 can at least partially be made of a nonporous material. By way of non-limiting examples, the intermediate panels 600 can comprise mesh, fabric, silicone, polymer, metal, and/or any other desired porous or non-porous material. In some embodiments intermediate panels 600 can be made of the same material as the first panel 202 and/or second panel 204, while in other embodiments intermediate panels 600 can be made of a different material and/or have a different level of transparency than the first panel 202 and second panel 204.

Figure 6A:
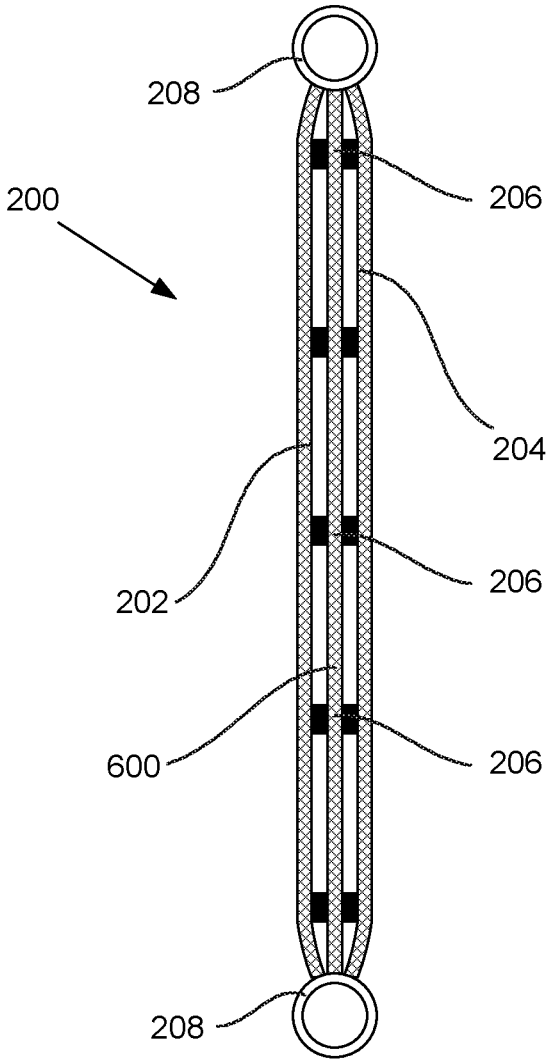
FIGS. 6A-6B depict an embodiment of a signage system comprising an intermediate member.

In some embodiments comprising one or more intermediate panel 600, spacers 206 can be positioned on either side of each intermediate panel 600 to space the intermediate panel at least partially apart from an adjoining panel. By way of a non-limiting example, FIG. 6A shows a single intermediate panel 600 between the first panel 202 and second panel 204, and a first set of spacers 206 is between the first panel 202 and the intermediate panel 600 to keep the first panel 202 and intermediate panel 600 at least partially apart, and a second set of spacers 206 is between the intermediate panel 600 and the second panel 204 to keep the intermediate panel 600 and second panel 204 at least partially apart. In other embodiments one or more spacers 206 can be configured to extend through one or more intermediate panels 600, such that a single spacer 206 contacts the first panel 202, extends through the one or more intermediate panels 600, and contacts the second panel 204. By way of a non-limiting example, the horizontal elongated member of the spacer 206 shown in FIG. 3A can pass through a pore in one or more intermediate panels 600, and the spacer's opposing vertical members can be coupled with the first panel 202 and second panel 204 respectively. In alternate embodiments dedicated spacers 206 can be absent, and the one or more intermediate panels 600 can act as spacers 206 by having thicknesses that can keep the first panel 202 and second panel 204 apart by a predetermined distance.

Figure 1A:
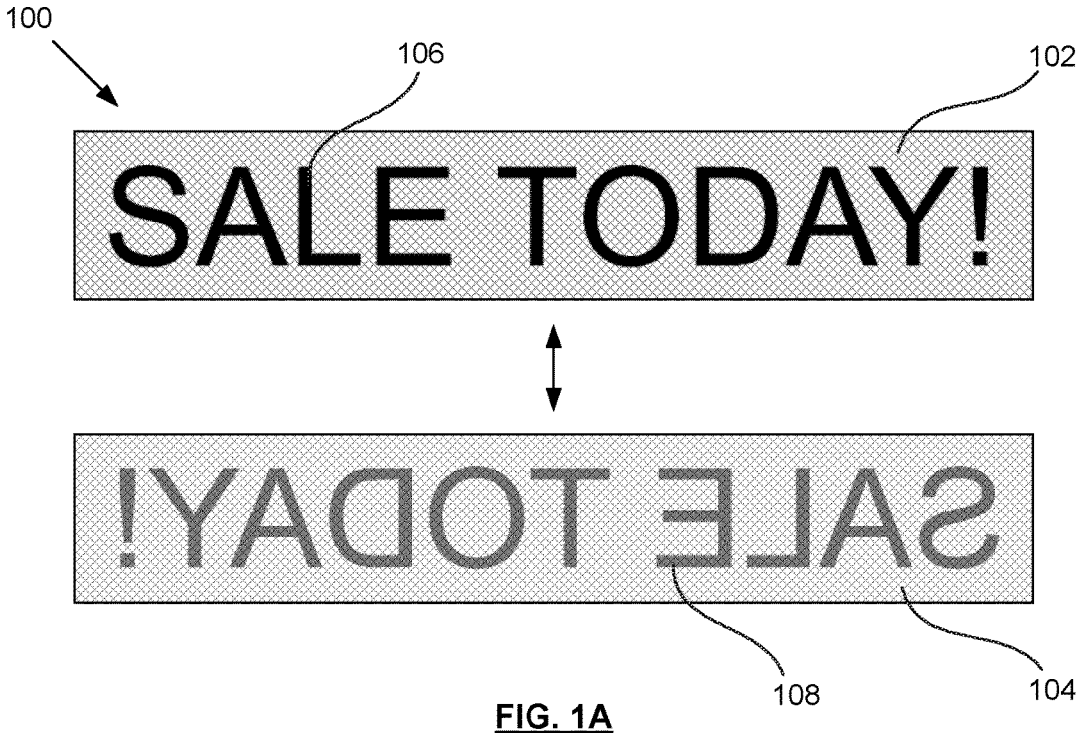
FIG. 1A Prior Art
FIGS. 1A-1C depict a prior art embodiment of a signage system.
Figure 1B:
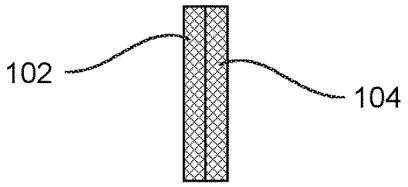
FIG. 1B Prior Art
Figure 1C:
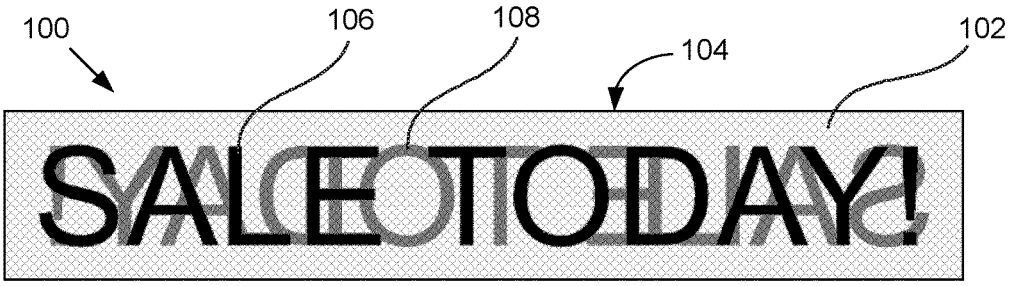
FIG. 1C Prior Art
Figure 6B:
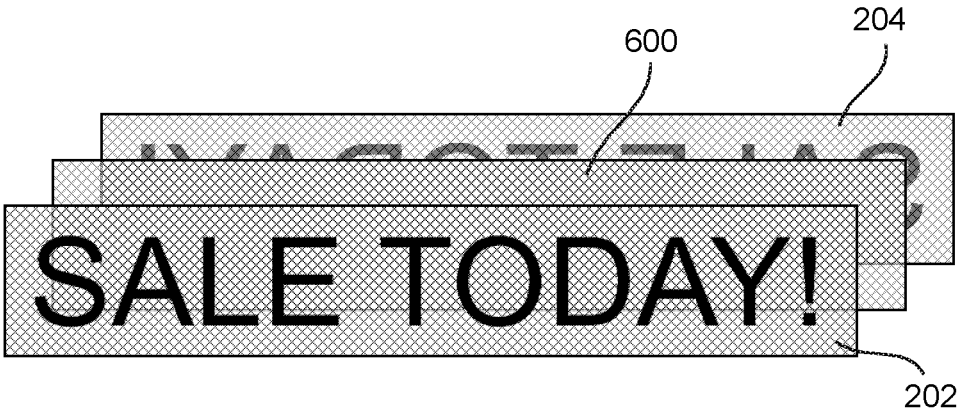

As can be seen from FIG. 6B, the presence of one or more intermediate panels 600 between the first panel 202 and second panel 204 can at least partially block visibility of the design 210 on the panel facing away from a viewer. By way of a non-limiting example, a viewer facing the first panel 202 can see the design 210 displayed on the first panel 202, but the design 210 on the second panel 204 that might otherwise be partially visible through the pores of the first panel 202 as shown in FIG. 1C or through shadowing can be at least partially blocked from view first by the distance between the first panel 202 and second panel 204 provided by the spacers 206, and also by the presence of one or more intermediate panels 600 between the first panel 202 and second panel 204.

Additionally, in some embodiments, one or more intermediate panels 600 can each have its own design 210, pattern, and/or color to provide a background for designs 210 on the first panel 202 and/or second panel 204. By way of non-limiting examples, the first panel 202 and second panel 204 can be made of mesh and can display designs 210, while one or more intermediate panels 600 can be a differently colored mesh to provide a backdrop of a contrasting color, and/or can display a background image designed to be viewed behind the primary designs 210 on the first panel 202 and second panel 204.

Figure 7:
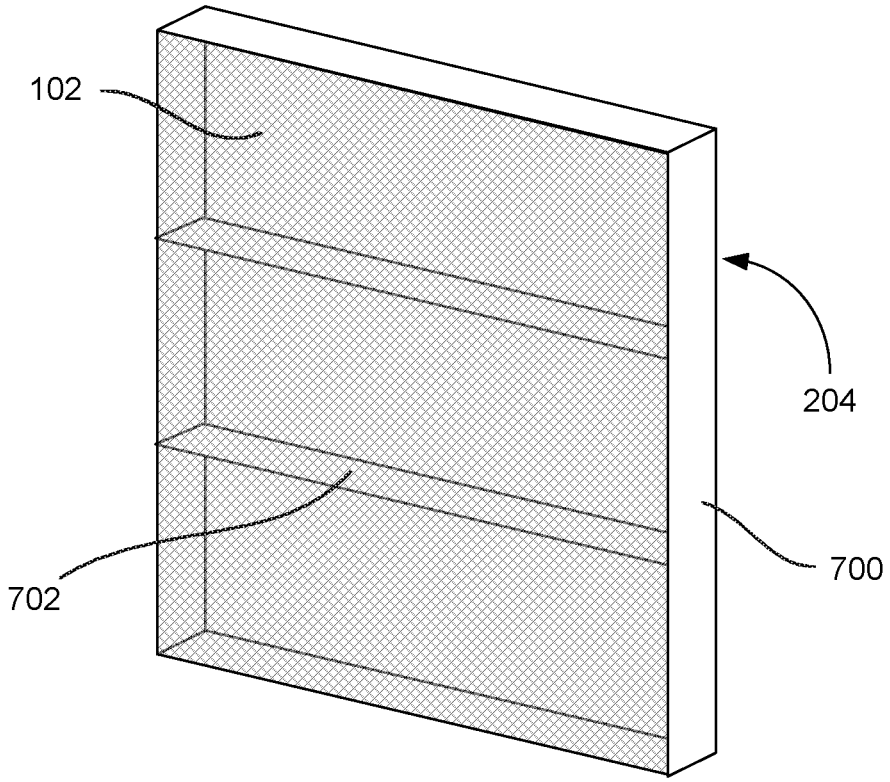
FIG. 7 depicts an embodiment of a signage system comprising a frame.

FIG. 7 depicts an alternate embodiment in which a signage system 200 comprises a frame 700. In some embodiments comprising a frame 700, the frame 700 can replace the spacers 206 and/or mounting members 208. By way of a non-limiting example, in these embodiments the frame 700 can serve as a spacer 206 to keep the first panel 202 and second panel 204 apart by a predetermined distance. In these embodiments, the first panel 202 and second panel 204 can be coupled with opposing sides of the frame 700 with adhesives, screws, bolts, snaps, hook and loop fasteners, or any other known and/or convenient manner of coupling.

The frame 700 can comprise one or more frame members 702 that are coupled together to form the frame 700. By way of a non-limiting example, FIG. 7 shows a frame comprising four outer frame members 702 that together form a rectangular shape, and two interior frame members 702 that extend between opposing sides of the frame 700. In other embodiments, any other number of frame members 702 can be present and can be arranged in any other configuration. By way of non-limiting examples, the frame members 702 can be arranged in a grid, in a cross-hatched configuration, in a circular configuration, as spokes of a wheel, or in any other configuration. The frame members 702 can comprise foam, wood, plastic, metal, mesh and/or any other desired material, and can be porous or non-porous.

Figure 8:
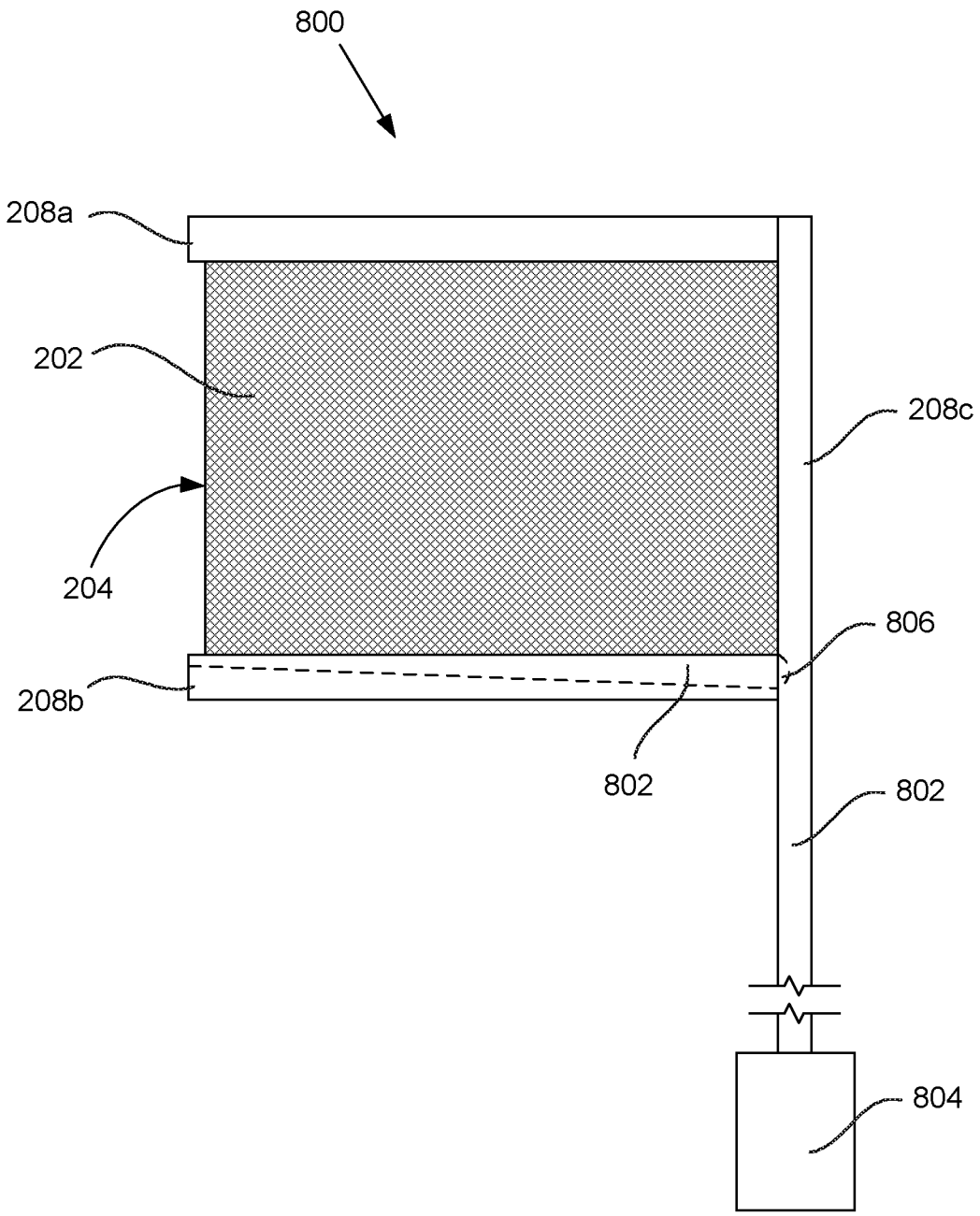
FIG. 8 depicts an embodiment of a signage system comprising a vapor collection system.

FIG. 8 depicts an alternate embodiment in which a signage system 200 further comprises a vapor collection system 800. A vapor collection system 800 can be configured to collect water droplets that condense on components of a signage system 200. As moisture and water droplets can condense on a signage system 200 when it is exposed to the elements, a vapor collection system 800 can collect the condensed water such that the water can be harvested for other uses. Embodiments of the signage system 200 that comprise a first panel 202 and/or second panel 204 made of porous material can have a larger surface area upon which moisture can condense than signage systems 200 made of nonporous materials, due to the pores of the porous material. However, however a vapor collection system 800 can be present in embodiments comprising either porous or nonporous materials. In some embodiments, one or more intermediate panels 600 can provide further surfaces for moisture to condense.

In some embodiments the vapor collection system 800 can be an embodiment of the vapor collection apparatus shown and described in patent application Ser. No. 14/149,731, entitled Residential Condensed Vapor Collection System and Method, filed on Jan. 7, 2014, herein incorporated by reference. In alternate embodiments the vapor collection system 800 can be absent.

In some embodiments that have a vapor collection system 800, one or more mounting members 208 can have channels 802 configured to transport, via gravity, droplets of moisture that have condensed on the signage system 200 to a storage vessel 804. A channel 802 can be a groove, trough, trench, gutter, recessed path, tube, or any other path through which condensed moisture can flow. In some embodiments, the channels 802 can be at least partially angled or inclined relative to a horizontal direction, such that condensed moisture can drain via gravity down to a lower position along the channel 802.

In some embodiments, a mounting member 208 can have a hollow interior that can serve as a channel 802, and can have one or more holes 806 through which droplets from the exterior of the mounting member 208 or from a different mounting member 208 can pass into the mounting member's hollow interior. In other embodiments, the mounting member 208 can have an open-top configuration, with sides of the mounting member 208 forming walls of a channel 802. By way of non-limiting examples, a mounting member 208 can have a substantially V-shaped cross-sectional geometry, or a substantially U-shaped cross-sectional geometry. In still other embodiments, a mounting member 208 can be configured or oriented such that moisture can pass along the exterior of the mounting member 208. By way of a non-limiting example, moisture can drip down the exterior of a vertically-mounted mounting member 208.

By way of a non-limiting example, FIG. 8 depicts an embodiment in which moisture can condense on the first panel 202, second panel 204, and/or any of the mounting members 208. Condensed moisture droplets can travel down surfaces of the signage system 200 through the force of gravity into a channel 802 in the mounting member 208*b* at the lower edge of the first panel 202 and second panel 204. The moisture can drain down the angled channel 802 of the mounting member 208*b*, and then pass through a hole 806 into an interior channel 802 of the vertically-mounted mounting member 208*c*. In alternate embodiments, the moisture can drip down the exterior of the vertically-mounted mounting member 208*c*. The moisture can drain down the mounting member 208*c* and be collected at the storage vessel 804 at the base of the mounting member 208*c*.

The storage vessel 804 can be a water receptacle configured to collect condensed moisture. In some embodiments, the storage vessel 804 can be selectively removable from the rest of the signage system 200 and/or vapor collection system 800, such that the storage vessel 804 can be removed and collected water can be retrieved, transferred to a different receptacle, or transported to another location. In alternate embodiments, the storage vessel 804 can comprise a drain or valve, through which collected water can be removed. Water accumulated by a vapor collection system 800 can be utilized in any desired manner, such as for watering plants or decreasing the amounts of water obtained from other sources, leading to water conservation.

Although the method has been described in conjunction with specific embodiments thereof, it is evident that many alternatives, modifications and variations will be apparent to those skilled in the art. Accordingly, the method as described and hereinafter claimed is intended to embrace all such alternatives, modifications and variations that fall within the spirit and broad scope of the appended claims.

What is claimed is:

1. A signage system, comprising:

a first porous panel;

a second panel;

one or more mounting members coupled with said first porous panel and said second panel;

a plurality of spacers; and one or more intermediate panels positioned between said first porous panel and said second panel, said one or more intermediate panels having an opacity different from an opacity of said first porous panel;

wherein each of said first porous panel and said second panel has an outer surface and an inner surface, the outer surface of said first porous panel displaying a first design and the outer surface of said second panel displaying a second design;

wherein said first porous panel and said second panel are arranged in a substantially parallel configuration;

wherein said plurality of spacers are coupled between the inner surface of said first porous panel and the inner surface of said second panel to keep portions of said first porous panel and said second panel apart by a predetermined distance; and wherein said at least one intermediate panel is comprised of a flexible material.

2. The signage system of claim 1, wherein said second panel comprises porous material.

3. The signage system of claim 2, wherein said opacity of said one or more intermediate panels is different from an opacity of said second panel.

4. The signage system of claim 1, wherein said second panel comprises nonporous material.

5. The signage system of claim 1, wherein said first porous panel and said second panel are separate pieces coupled with said one or more mounting members.

6. The signage system of claim 1, wherein said first porous panel and said second panel are portions of a single piece of material, and said single piece of material is draped over one of said one or more mounting members.

7. The signage system of claim 1, wherein said plurality of spacers each have a horizontal elongated member coupled between two vertical members.

8. The signage system of claim 7, wherein a protrusion extends from at least one of said two vertical members, said protrusion being configured to extend through a pore in said first porous panel or said second panel.

9. The signage system of claim 1, wherein said plurality of spacers are each an S-shaped hook.

10. The signage system of claim 1, further comprising a first weighted member coupled with said first porous panel and a second weighted member coupled with said second panel.

11. The signage system of claim 1, wherein said at least one of said one or more intermediate panel displays a third design.

12. The signage system of claim 1, further comprising a vapor collection system, wherein at least one of said one or more mounting members comprises a channel configured to transport water via gravity to a storage vessel after said water has condensed on said first porous panel, said second panel, or said one or more mounting members.

13. A method of constructing a layered sign, comprising displaying a first design on a surface of a first porous panel;

displaying a second design on a surface of a second panel;

coupling a plurality of spacers between said first porous panel and said second panel, such that said plurality of spacers keeps portions of said first porous panel and said second panel apart by a predetermined distance;

coupling said first porous panel and said second panel with one or more mounting members such that said first design and said second design face different directions; and coupling one or more intermediate panels with said one or more mounting members such that said one or more intermediate panels are between said first porous panel and said second panel; wherein said one or more intermediate panels has a transparency different from a transparency of said first porous panel;

wherein said at least one intermediate panel is comprised of a flexible material.

14. The method of claim 13, wherein said second panel comprises porous material.

15. The method of claim 14, wherein said transparency of said one or more intermediate panels is different from a transparency of said second panel.

16. The method of claim 13, wherein said second panel comprises nonporous material.

17. The method of claim 13, further comprising:

forming a channel in at least one of said one or more mounting members, said channel being configured to transport water via gravity to a storage vessel after said water has condensed on said first porous panel, said second panel, or said one or more mounting members.

18. The method of claim 13, wherein:

displaying said first design comprises printing said first design on said first porous panel, and displaying said second design comprises printing said second design on said second panel.

19. The method of claim 13, wherein:

displaying said first design comprises affixing a first decal on said first porous panel, and displaying said second design comprises affixing a second decal on said second panel.

* * * * *